US005845814A

United States Patent [19]

Nobbio

[11] Patent Number: 5,845,814

[45] Date of Patent: Dec. 8, 1998

[54] BOTTLE FOR SEPARATEDLY PRESERVING SUBSTANCES AND SUBSEQUENTLY DISPENSING THEIR MIXTURE DROPWISE

[75] Inventor: Alessio Nobbio, Garbagnate Milanese, Italy

[73] Assignee: INGE S.p.A., Milan, Italy

[21] Appl. No.: 855,721

[22] Filed: May 8, 1997

[30] Foreign Application Priority Data

May 8, 1996 [IT] Italy ..... MI 96/U/000338

[51] Int. Cl.[6] ..... B67D 5/56

[52] U.S. Cl. ..... 222/129; 222/153.06; 206/221

[58] Field of Search ..... 222/129, 145.1, 222/153.06, 153.09, 420; 206/221; 604/89–91

[56] References Cited

U.S. PATENT DOCUMENTS

| | | | |
|---|---|---|---|
| 3,924,741 | 12/1975 | Kachur et al. | 206/221 |
| 5,383,579 | 1/1995 | Lanfranconi et al. | 222/129 |
| 5,474,209 | 12/1995 | Vallet Mas et al. | 206/221 |
| 5,613,623 | 3/1997 | Hildenbrandt | 206/221 |

FOREIGN PATENT DOCUMENTS

| | | |
|---|---|---|
| 0 634 340 | 1/1995 | European Pat. Off. . |
| 2 353 455 | 12/1977 | France . |
| 31 40 398 | 9/1982 | Germany . |
| 42 38 819 | 5/1993 | Germany . |
| WO 97/11008 | 3/1997 | WIPO . |

*Primary Examiner*—Philippe Derakshani
*Attorney, Agent, or Firm*—Pillsbury Madison & Sutro LLP

[57] ABSTRACT

The purpose of the bottle is to enable substances to be separatedly preserved and the mixture of said substances to be subsequently dispensed dropwise only under the control of the operator. The bottle (1) comprises a container (2) and a closure element (3) applicable to its mouth (5). The closure element (3) comprises a pump (7) provided with a dispensing orifice (26) and accessible to the user's fingers through at least one opening (13) in the cap (6). A separator element (8) is housed in the interior of said pump (7), and is removable for squeezing the pump.

5 Claims, 3 Drawing Sheets

BOTTLE FOR SEPARATEDLY PRESERVING SUBSTANCES AND SUBSEQUENTLY DISPENSING THEIR MIXTURE DROPWISE

BACKGROUND OF THE INVENTION

This invention relates to a bottle for separatedly preserving substances and subsequently dispensing them dropwise as a mixture. Bottles of this type are known, for example from Italian industrial invention patent No. 1,073,125 dated 27 Oct., 1976. The mixture is dispensed by inverting the bottle to utilize the force of a gravity, which consequently results in the formation of droplets at the dispensing orifice. Although these bottles correctly preserve the substances, their dispensing is not satisfactory if the substances have to be dispensed with precision both in terms of quantities and in terms of each accuracy of the point on which the dispensed droplet falls. These specific requirements are felt, for example in the ophthalmic field, in which accurate dispensing is necessary in terms both of quantity and positional accuracy of the collyrium droplets, together with the need for ensuring optimum preservation of the medicament, even if this is formed from components which when mixed together, give rise to a mixture of poor chemical stability and hence of limited preservation.

SUMMARY OF THE INVENTION

The object of the present invention is therefore to provide a bottle of the aforesaid type, which is of satisfactory use when accurate dispensing is necessary in terms both of quantity and position of the droplets of a mixture of substances preserved in separated relationship until just prior to dispensing.

As the mixture substances can be separatedly preserved, the mixture preservability is increased and dispensing can be accurate in terms both of quantity and position, as this takes place only under the control of the operator.

BRIEF DESCRIPTION OF THE DRAWINGS

The invention is illustrated by way of non-limiting example in the figures of the accompanying drawings, which relate in particular to a bottle for ophthalmic use and hence are intended to contain a medicament (collyrium) for instilling into a subject's eyes.

DETAILED DESCRIPTION

Figure 1:
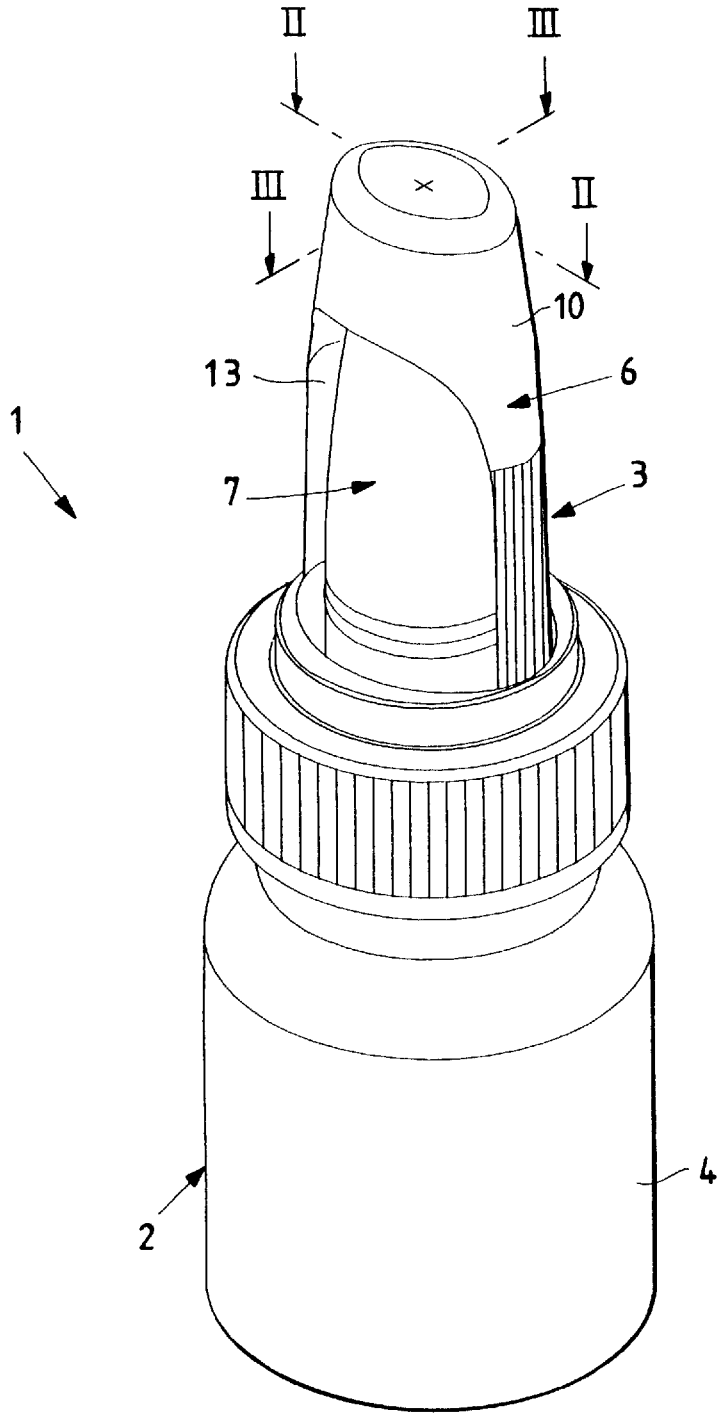
FIG. 1 is a perspective view of the bottle.
Figure 2:
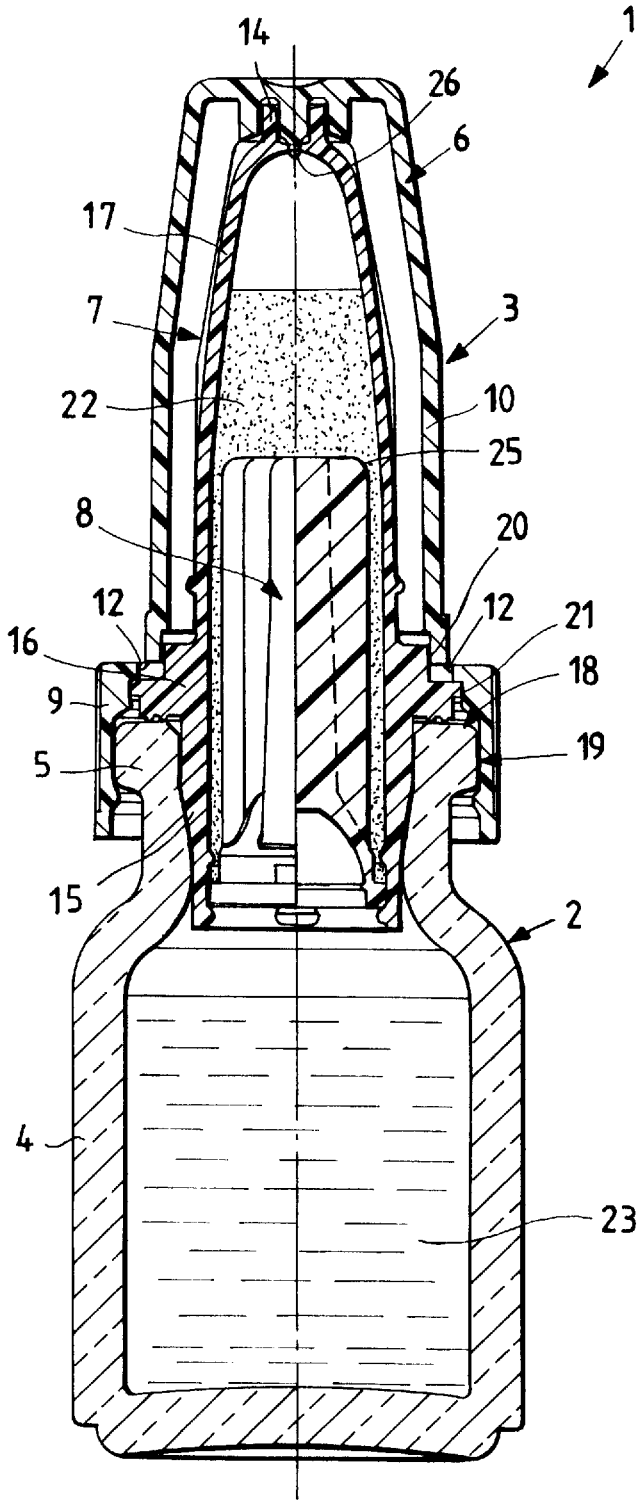
FIG. 2 is a section on the line II—II of FIG. 1.
Figure 3:
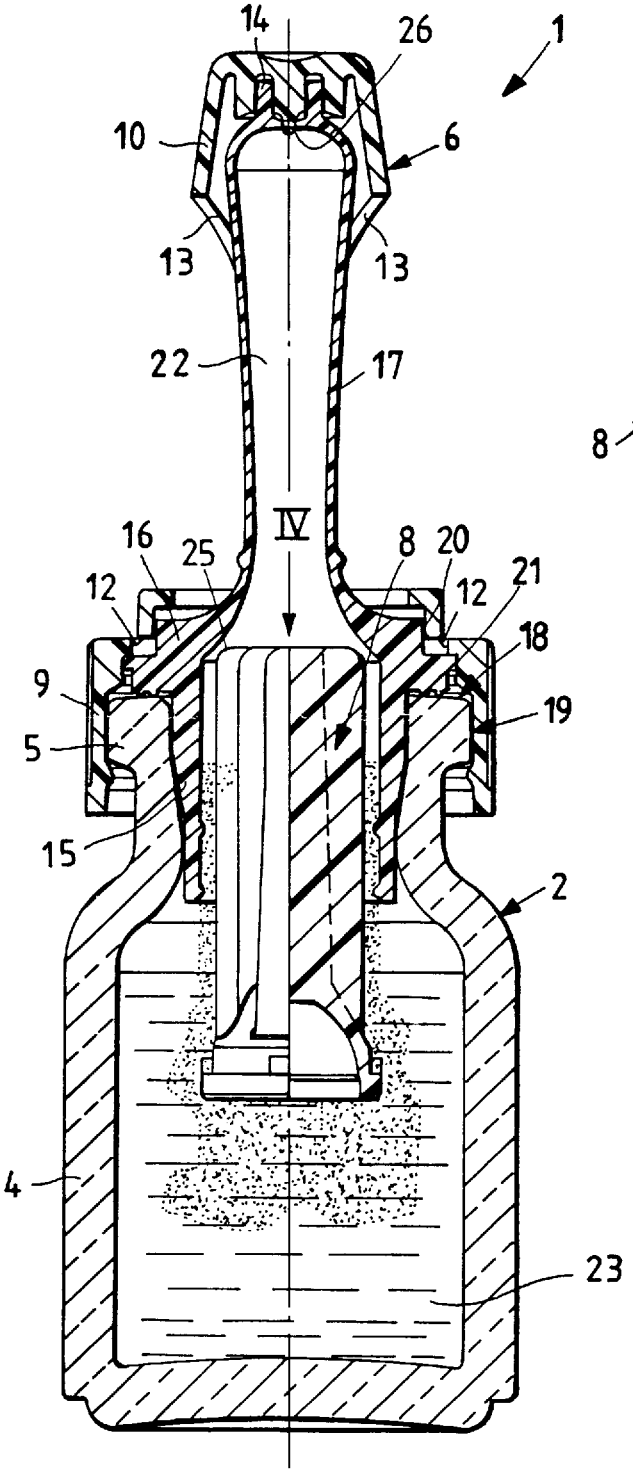
FIG. 3 is a section on the line III—III of FIG. 1, one part however being shown deformed by the effect of the action of a hypothetical user, necessary for forming the mixture of the contained substances.
Figure 4:
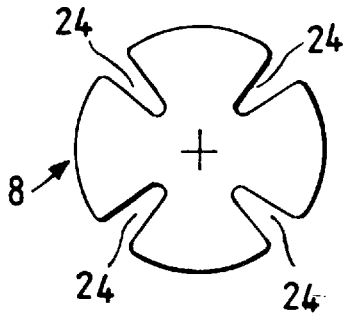
FIG. 4 is a view in the direction of the arrow IV of FIG. 3.

With reference to the above-identified drawing figures, the illustrated bottle, indicated overall by the numeral 1, comprises a container 2 and a closure element 3. The container 2 comprises a body 4 and a mouth 5. The closure element 3 comprises a cap 6, a pump 7 and a separator element 8. The cap 6 comprises a fastening seal 9 and a sealing element 10 which hermetically seals a nozzle 14.

The fastening seal is connected to the sealing element 10 by predetermined fracture strips 12, the purpose of which is to indicate the removal of the sealing element 10, and hence the fact that the bottle 1 has been opened. The sealing element 10 is provided with at least one opening 13, two opposing openings being shown provided in the example. The function of the opening will be apparent hereinafter. The pump 7 comprises a base portion 15, a flange 16, a deformable portion 17 and the nozzle 14. The base portion can be forcibly inserted into the mouth 5 of the container 2 such that the flange 16 abuts against the front surface 18 of the mouth 5. The fastening seal 9 seals the pump 7 to the mouth 5 of the container 2. The sealing element 10 and the guarantee seal 9 initially form a one-piece element located on the container 2 and respective pump 7. The one-piece element 9–10 engages with adequate interference the nozzle 14, an upper and lower annular lateral surface 20 and 21 respectively of the flange 16, and the lateral surface 19 of the mouth 5.

The separator element 8 is positioned within the pump 7 and fits tightly into the base portion 15 so as to provide a hermetic seal separating the inner space 22 of the deformable portion 17 from that 23 of the body 4. The separator element 8 is of substantially cylindrical form with its upper end 25 tapered, and carries longitudinal rectilinear grooves 24 in its outer surface. The tapered upper end, the cylindrical form and the grooves 24 facilitate the expulsion of the separator element 8 from the pump 7 when the separator element is squeezed by a user's fingers. The grooves 24 also perform the function of facilitating gravity fall of the substance, preferably a powder, contained in the space 22, the substance contained in the space 23 usually being a liquid acting as a solvent for that powder. However, there is nothing to prevent the substances from being two liquids. The function of the openings 13 is to enable the deformable portion 17 to be squeezed by acting through the sealing element 10, which can be removed by the user only after the powder-solvent mixture has been obtained. The same applies to a mixture of two liquids. In this manner, the bottle can be shaken to facilitate mixture formation with the bottle still sealed, and hence obtain a solution ready for use still within the sealed container. Thus, the solution obtained in the bottle remains isolated from the external environment, with all the resultant advantages.

By fracturing the strips, 12 the sealing element 10 can be removed, hence opening the orifice 26 of the nozzle 14. The dimensions of the orifice 26 are such as to enable the obtained mixture to be dispensed only by squeezing the deformable portion 17, and hence only under the control of the user. Consequently, the user can invert the bottle and position it vertically above the point at which administration is required (for example the eye), without danger of premature flow of the mixture.

I claim:

1. A bottle for separatedly preserving two substances and for subsequently dispensing dropwise resulting from mixing the two substances comprising:

a container body having a mouth, and a closure element applied to the mouth of said container;

said closure element comprising a cap having at least one opening, and a pump having an interior and being provided with a dispensing orifice;

said pump being accessible to a user's fingers through said at least one opening; and said closure element further including a separator element housed in said interior of said pump, and being removable for squeezing said pump.

2. The bottle as claimed in claim 1, wherein:

said separator element is of substantially cylindrical form with a tapered upper end.

3. The bottle as claimed in claim 1, wherein:

said separator element has rectilinear longitudinal grooves provided in an outer peripheral surface thereof.

4. The bottle as claimed in claim 1, wherein:

said pump further comprises a base, a flange and a deformable portion provided with a nozzle having an orifice which has such dimensions as not to enable said fluid, mixture when contained in said bottle to spontaneously emerge from said bottle.

5. The bottle as claimed in claim 4, wherein:

said pump is secured to said mouth of said container by a fastening seal which locks said flange to said.

* * * * *